US009702094B2

(12) United States Patent
Thomson

(10) Patent No.: US 9,702,094 B2
(45) Date of Patent: Jul. 11, 2017

(54) METHOD AND APPARATUS FOR FORMING TUNNELS AND TUNNELS FORMED THEREBY

(71) Applicant: James Crawford Thomson, Geneva (CH)

(72) Inventor: James Crawford Thomson, Geneva (CH)

( * ) Notice: Subject to any disclaimer, the term of this patent is extended or adjusted under 35 U.S.C. 154(b) by 0 days.

(21) Appl. No.: 14/762,067

(22) PCT Filed: Jan. 24, 2014

(86) PCT No.: PCT/GB2014/050183
§ 371 (c)(1),
(2) Date: Jul. 20, 2015

(87) PCT Pub. No.: WO2014/114941
PCT Pub. Date: Jul. 31, 2014

(65) Prior Publication Data

US 2015/0322630 A1 Nov. 12, 2015

(30) Foreign Application Priority Data

Jan. 25, 2013 (GB) ..... 1301318.0

(51) Int. Cl.
*E01C 1/02* (2006.01)
*E02D 29/045* (2006.01)
(Continued)

(52) U.S. Cl.
CPC ..... *E01C 1/02* (2013.01); *E01C 1/002* (2013.01); *E02D 29/045* (2013.01); *E02D 29/055* (2013.01); *E21D 9/04* (2013.01)

(58) Field of Classification Search
CPC combination set(s) only.
See application file for complete search history.

(56) References Cited

U.S. PATENT DOCUMENTS 3,442,088 A 5/1969 Borisof
6,406,220 B1 * 6/2002 Thomson ..... E21D 9/005 405/132
2001/0006304 A1 * 7/2001 Seear ..... E21C 41/16 299/18

FOREIGN PATENT DOCUMENTS

JP 06185294 7/1994
JP H06 185294 A * 7/1994
(Continued)

OTHER PUBLICATIONS

International Searching Authority Search Report, Issued in connection to International Application No. PCT/GB2014/050183, 10 pages Feb. 9, 2015.

*Primary Examiner* — Kyle Armstrong
(74) *Attorney, Agent, or Firm* — McKee, Voorhees & Sease, PLC

(57) ABSTRACT

A method of forming tunnels(6), and tunnels formed thereby, said tunnels in one embodiment being of a form to carry transport routes (1) such as rail and road transport therealong. The method allows the tunnel to be formed from one or more access points (2) by allowing the tunnel structure (6) to be progressively extended out from the tunnel by advancing deck structures (24) along guide means (20) which are formed as part of a base structure (18). The deck structures (24) can also be used to support excavation equipment (28) and/or act as transport routes for access to the leading edge of the tunnel as it is formed. This greatly reduces the need for separate access and works to be provided adjacent to the tunnel as it is formed and therefore reduces the level of reinstatement works required after the tunnel has been formed.

15 Claims, 3 Drawing Sheets

(51) Int. Cl.

| | |
|---|---|
| ***E02D 29/055*** | (2006.01) |
| ***E01C 1/00*** | (2006.01) |
| ***E21D 9/04*** | (2006.01) |

(56) References Cited

FOREIGN PATENT DOCUMENTS

| | | |
|---|---|---|
| JP | 06346699 | 12/1994 |
| JP | 2001336164 | 12/2001 |
| WO | 2012017314 A2 | 2/2012 |

* cited by examiner

METHOD AND APPARATUS FOR FORMING TUNNELS AND TUNNELS FORMED THEREBY

CROSS-REFERENCE TO RELATED APPLICATIONS

This is a National Phase application claiming priority to PCT/GB2014/050183 filed Jan. 24, 2014 which claims priority to GB 1301318.0 filed Jan. 25, 2013, all of which are herein incorporated by reference in their entireties.

The invention to which this application relates is a method and apparatus for forming structures such as tunnels and, in particular, although not necessarily exclusively, for forming tunnels of a type which are known in the art as "green tunnels" and which term is hereinafter referred to for ease of illustration and in a non-limiting manner.

Green tunnels are a form of structure in which the aim is to form the tunnel for a particular service such as a road, railway, waterway, or the like and, once formed, to return the surface above and/or adjacent the tunnel structure to, or close to, it's original condition or another predefined condition. Typically the aim is to return the scenery and/or usage of the said surface to as close as possible to what it was prior to the performance of the tunnelling, or to another predefined condition. Increasingly, the formation of routes for new transport and/or communication services, such as high speed rail services in the United Kingdom, and/or highways or motorways cause considerable controversy and resistance due to the real and/or perceived, impact that the same will have on the landscape and environment through which the new route is to pass. In an effort to mitigate this problem it is increasingly the case that the specification for any tunnelling or excavation, and at least for tunnelling or excavation at relatively shallow depths from the surface, requires the tunnel structure which is to be formed as being specified as having to be a green tunnel.

Conventionally, the approach to forming green tunnels is to excavate the soil and rock to form a trench along the path of the new route to the required depth and then to form the tunnel progressively along the route by casting the base, walls and roof of the tunnel using formwork, reinforcement and concrete. This is a slow process and requires many frequent deliveries of materials, and personnel to the locations where the tunnel is being formed and the removal of material and personnel in the opposite direction along the route as the tunnel is formed which requires significant transport access to be formed and causes large scale disruption to the surrounding environment. This also significantly increases the overall size of the area of the landscape which is required to be disturbed, and subsequently reinstated, in order to allow the tunnel structure to be formed.

Furthermore, access for transport is required to be provided at all points along the route in order to service the works and to allow the delivery of the box units and/or materials for casting m-situ and movement to the location for use on the route, and also the movement of the material following excavation and, thereafter, to allow reinstatement. The use of existing access roads and/or formation of new access roads can cause significant disruption to residents and the local environment in the area and, in itself, requires excavation works which need to be reinstated subsequently. As a result of this, while it is the case that the works can eventually be reinstated to form a green tunnel, the extent of the reinstatement which is required using the conventional method and apparatus is significant, disruptive and can be costly.

The aim of the present invention is therefore to provide a method and apparatus which allows the formation of tunnels in a form which allows the preparatory work and the subsequent works performed in order to meet the requirement for reinstatement of the material above and adjacent to the green tunnel which has been formed to be minimised. A further aim is to allow the support infrastructure required for the formation of the tunnel to be reduced.

In a first aspect of the invention there is provided a method of forming a tunnel, said method comprising the steps of forming at least one access point along the route of the said tunnel, forming at least one support base in at least one direction away from the access point along said route, providing the support base with guide means thereon, and wherein at least one deck structure is advanced along the guide means to form at least the roof of at least a portion of the tunnel so that at least a portion of the said tunnel is formed outwardly from the said access point along said route.

Typically a plurality of deck structures are advanced in succession along the guide means to form at least the roof of at least a portion of the tunnel.

In one embodiment at least the lower part of the tunnel walls are formed from upstanding parts of the support base, which is formed by a plurality of units advanced into position as excavation works are performed. In one embodiment the deck structures include downwardly depending portions which form part of the side walls of the tunnel.

In one embodiment the said tunnel portion extends from the access point to an end of the tunnel or, alternatively, to a further access point spaced from the first.

In one embodiment a plurality of tunnel portions are extended outwardly from an access point in the direction of said tunnel route, said portions typically angularly offset around the access point. Typically the said tunnel portions extend outwardly from the access point in opposing directions and extend the tunnel along the route in opposite directions from the access point.

Typically, the support base is formed by two spaced apart base portions, each of which includes guide means thereon such that the deck structures are supported by, and span between, the respective guide means.

Typically the support base portions are installed along access tunnels which are formed along the route and which extend from the access point. The access tunnels which are formed allow access for piling and the support base units to be installed therealong and the guide means to be exposed when required to allow the deck structures to be moved, typically by jacking, along the same.

In one embodiment each support base portion includes a series of piles depending downwardly therefrom, a base unit and on the upper and/or side walls thereof guide means are formed.

In one embodiment excavation works are performed in front of the leading deck structure to define the cavity which is to form the tunnel.

In one embodiment the deck structures are cast at the access point from which the same are to be advanced along the guide means or are transported to the access point and from which the same are then advanced along the guide means.

Typically the deck structures are moved along the guide means by jacking means provided at the access point. In one embodiment, further jacking apparatus may be provided at a location spaced along the tunnel route from the access point to provide further jacking forces if required.

Typically, the excavation of material in advance of the leading deck structure is required in the area between the support base portions in order to form the main cavity of the tunnel. The excavation can be performed using one, or a combination, of tunnelling excavation in which a shield is provided at the leading deck structure and tunnelling excavation is performed, and/or open excavation in which the excavation work is performed along and downwardly from the surface.

In one embodiment a portion of the tunnel is formed at or adjacent to the access point and which may form an end of the tunnel or a portion of the tunnel intermediate the tunnel ends.

Typically tunnelling excavation methods will be performed when the tunnel to be formed is located relatively deep below the surface and open excavation methods will be performed when the tunnel is to be formed at a relatively shallow depth from the surface.

In one embodiment, excavation apparatus can be located on the one or more leading deck structures which have been advanced in to position and which are adjacent the location at which excavation is to be performed, thereby avoiding the need for significant disruption to the land to the side of the tunnelling route or the need for significant additional land on one, or both sides, of the route to be provided.

Typically, in which ever form of excavation, the material which is removed may be placed to one side of the route for subsequent use for reclamation or removal or, alternatively, may be placed onto vehicles which use the top of the installed deck structure as a transport path back to the access point and, thereafter, access to the local transport infrastructure.

Typically the length of the tunnel formed from any given access point can be dependent upon a number of parameters such as the depth of excavation, the size of the tunnel to be formed, and the like, and is therefore unlimited in many instances. For example, lengths of tunnel of 1 km can be achieved in each direction therefore meaning that a tunnel of 2 km in length can be formed from a single access point. This therefore represents significant savings in terms of additional excavation works, the amount of land which is disrupted and the support transport infrastructure which is required to be formed.

Typically, once the tunnel is formed, material can be moved over the top of the deck structure, either from the side where the excavated material was deposited or from transported material which again may be transported along the top of the deck structure. Thus the surface above the structure can be reinstated as required with minimum disruption.

In a further aspect of the invention there is provided a method of forming a tunnel, said method comprising the steps of forming at least one access point along the route of the said tunnel, said tunnel structure is partially formed by forming at least one support base in at least one direction away from the access point along said route, and wherein the remainder of the tunnel structure is formed by a plurality of deck structures which are progressively advanced along the route from the access point and in contact with the support base.

In one embodiment a plurality of access points are provided along the tunnel route and are interlinked by the tunnel structure which is advanced from and between the access points. Typically the access points form part of the tunnel structure.

A tunnel formed using the method as described above is also claimed.

In a further aspect of the invention there is provided a tunnel, said tunnel formed from a support base including guide means formed thereon, side walls and a roof structure formed from one or more deck structures movable along and supported by the guide means of the support base and wherein said tunnel includes at least one access point from which the deck structures are advanced along the guide means and from which at least part of the said tunnel apparatus extends.

Typically the support base includes first and second, spaced apart portions in which the guide means are formed and the deck structures are located on and span the guide means of the respective support base portions.

In one embodiment the tunnel comprises a first series of deck structures which define a first portion of the tunnel and a second series of deck structures, spaced from the first, which define a second portion of the tunnel.

In one embodiment the said passageways are spaced apart along a substantially horizontal plane. Alternatively, or in addition, the passageways are spaced apart along a substantially vertical plane.

Specific embodiments of the invention are now described with reference to the accompanying drawings wherein.

Figure 1:
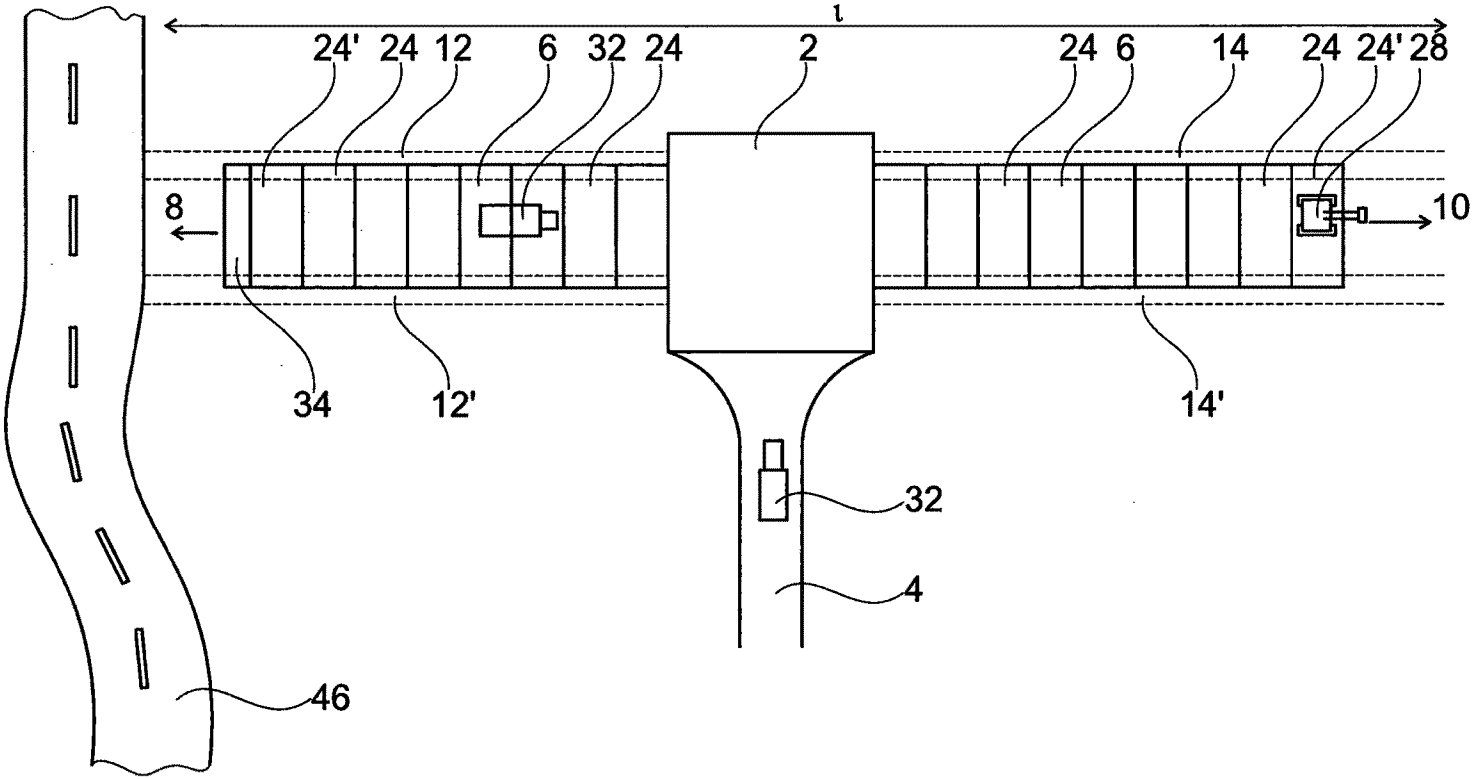
FIG. 1 illustrates in plan a tunnel formed in accordance with the invention in one embodiment.

Referring firstly to FIG. 1 there is illustrated in plan the formation of a tunnel structure 6 along a route 1 in accordance with one embodiment of the invention. There is shown an access point 2 which is located along the route of the tunnel which is to be performed. Typically the location and/or number of the one or more access points 2 will be determined with respect to any, or any combination, of the length of the tunnel, geological factors, access infrastructure, services which cross the route, depth of the tunnel and/or local and/or environmental concerns. It is also possible that there may be a number of access points provided along the length the tunnel route.

A service road 4 may already be present or is formed so as to allow the transport of personnel, apparatus and removal and provision of materials to be performed via the access point and the road 4. In this case the tunnel 6 is shown as being formed in two directions 8,10 from the access point along the required route 1. In order to achieved this the following method steps can be performed with reference to FIGS. 1-3

At the access point 2 a pit or shaft is excavated and this will ultimately form part of the tunnel structure 6 as well as acting as access means during the formation of the tunnel structure 6. From the pit or shaft, access tunnels 12, 12' and 14,14' are formed along the tunnel route, in the directions 8 and 10 respectively. From within the access tunnels piles 16 are formed downwardly and support base units 18 are placed along the access tunnels from the access point and are supported by the piles. Alternative methods can be used such as piling alone from the surface and/or placing a beam on top of the same.

In the embodiment shown, guide means 20 are formed in the support base portions 22,22' which are formed along the access tunnels 12,12',14,14' and, when required the guide means can be exposed for use. The guide means are provided to have low friction whilst providing guidance for the movement of deck structures therealong and the guide means and or deck structures may include a low friction coating and/or guide tracks may be provided.

Typically the guide means are only exposed soon before the advancement of the deck structures 24 in the directions 8 and 10 respectively from the access point 2. The deck structures are successively added and jacked along the guide means in the respective directions from the access point 2.

Figure 2:
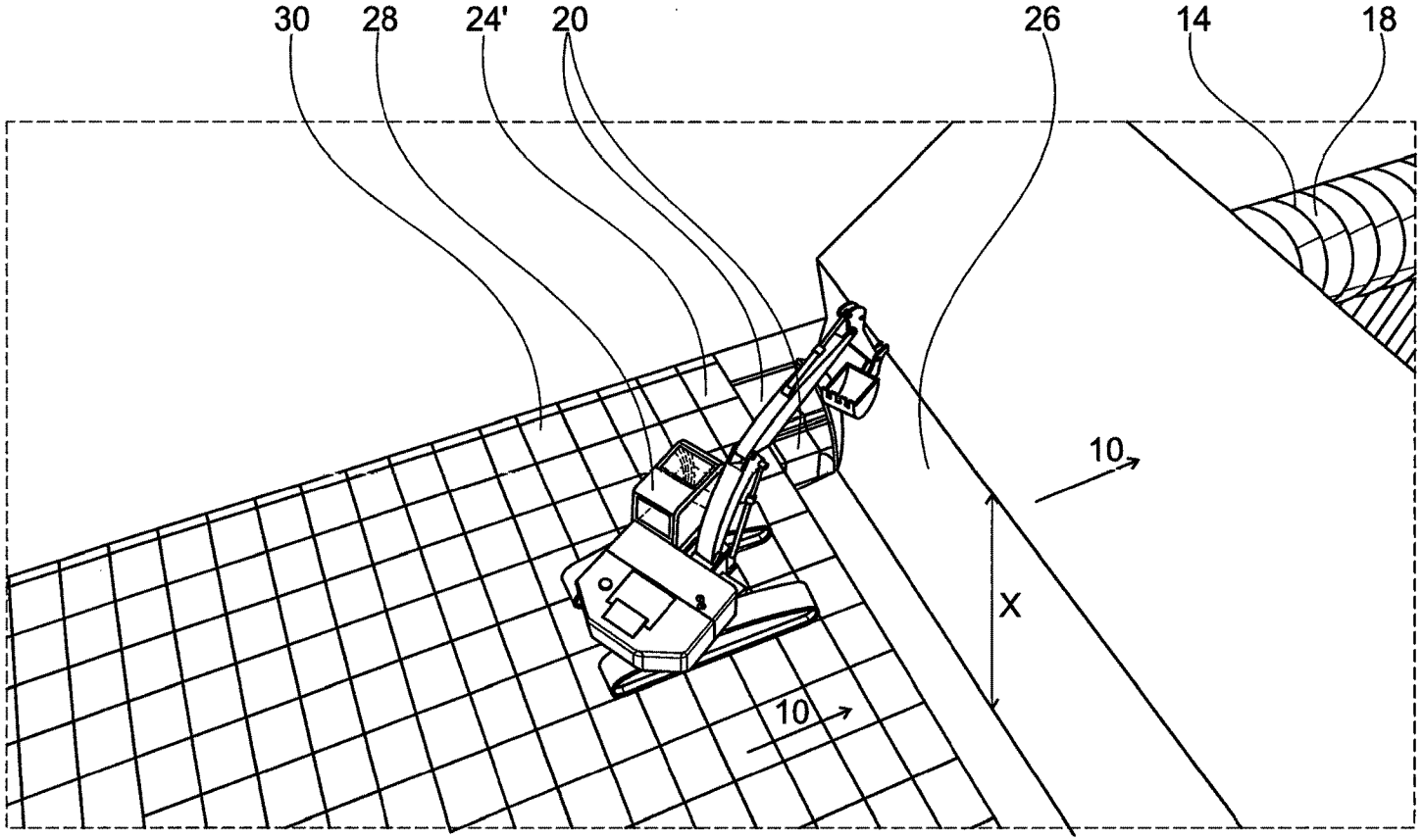
FIG. 2 illustrates a perspective view of the formation of the leading edge of a tunnel in accordance with one embodiment of the invention.
Figure 3:
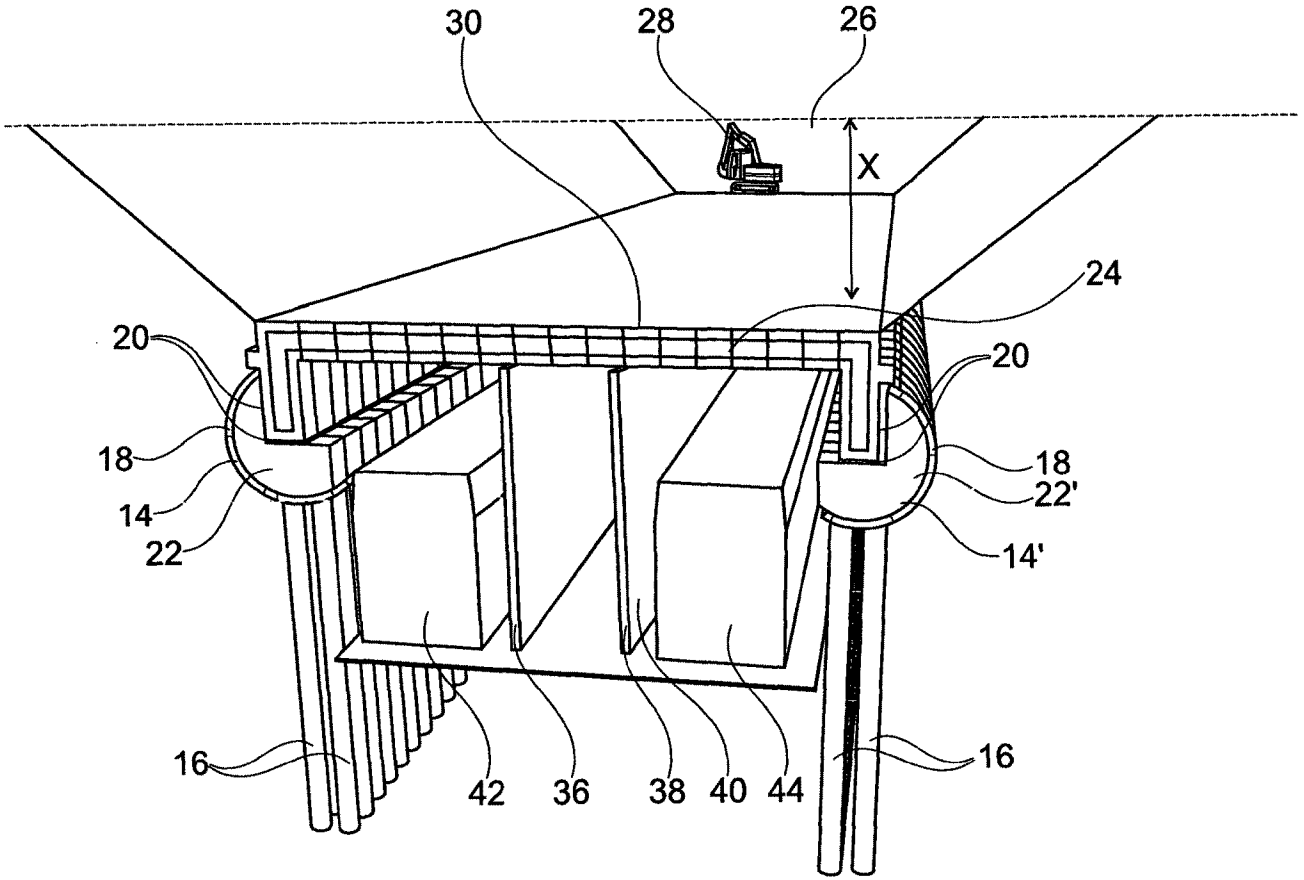
FIG. 3 illustrates a perspective view of the formation of a tunnel from an access point.

Ahead of the leading deck structure 24' there is a need to excavate the material, typically soil and rock 26, which lies ahead of the deck structures. In FIGS. 2 and 3 the depth X of the material 26 is sufficiently shallow from the surface to the base of the cavity which is to be formed so as to allow open cut excavation to be performed from above the deck structure and it is shown in this case how the excavation work is performed by excavation apparatus and plant 28 which is located on the top faces 30 of the deck structures 24 which have already been advanced into position along the guide means from the access point. This therefore means that no disruption of the soil and environment to either side of the tunnel route 1 is required thereby minimising the excavation work required and the subsequent reinstatement work which is required.

Furthermore, as shown in FIG. 1, transport vehicles 32 can also use the top surface 30 of the installed deck structures 24 as transport and access means between the leading edge of the tunnel structure as it is being formed and the access point 2, thereby minimising or avoiding the need for additional access roads to be formed to allow the movement of materials to service the formation and reinstatement of the tunnel structure 6.

Also shown in FIG. 1 is that in the direction 8, rather than open cut excavation being performed ahead of the leading deck structure 24, tunnelling excavation is being used with a shield 34 provided in which the tunnelling is performed. Most typically this will be performed where the required depth of the tunnel below the surface is greater and/or where a top surface service such as a road, rail, river or canal 46 is already in existence and crosses the route 1 of the tunnel and there is a desire to avoid disruption of the same. Also, the tunnelling excavation may only be performed for part of the excavation distance and open excavation methods used for the remainder.

If necessary, partition walls 36,38 may be installed in the interior of the tunnel cavity 40 to form, in the case shown in FIG. 3, first and second, separate tram passages 42, 44 in the tunnel cavity 40.

Once the tunnel structure 6 is formed, the top surface 30 of the deck structures 24 can be overlaid with material 26 and then landscaped as required to provide the full reinstatement of the environment above the tunnel.

It is envisaged that the invention will be of particular use when forming tunnels for use in carrying transport routes such as rail and road transport. For example, when forming roads an open trench can be formed and the tunnel structure is installed below and/or along the existing road. Conventionally the techniques used would take up a lot of space on the existing road and limit use of the same during construction works but this can be avoided in the apparatus and method of the current invention as it allows the tunnel structure to be installed without disruption of existing roads, and other installations such as crossroads, pipelines, cables etc. to be achieved.

The invention claimed is:

1. A method of forming a tunnel under a surface, said method comprising the steps of forming at least one access point along the route of the said tunnel, forming at least first and second support bases in at least one direction away from the access point along said route, providing the support bases with guide means thereon, and a plurality of deck structures are advanced along the guide means to be supported by, and span between, the respective guide means to form at least the roof of at least a portion of the tunnel so that at least a portion of the said tunnel is formed outwardly from the said access point along said route wherein excavation work is performed to remove the material from the surface to the top face of the deck structures which have been advanced into position to allow the top face of the said deck structures to be available for the positioning of excavation apparatus thereon to perform further excavation work and/or for vehicles to move along the top face of the said deck structures to transport excavated material, and once the tunnel is formed, material is moved over the top face of the deck structures, to allow reinstatement work to be performed.

2. The method according to claim 1 wherein the said tunnel portion extends from the access point to an end of the tunnel or to a further access point spaced from the first access point.

3. The method according to claim 1 wherein a plurality of the tunnel portions are extended outwardly from the at least one access point in the direction of said tunnel route, said portions typically angularly offset around the access point.

4. The method according to claim 1 wherein at least first and second support bases are installed along access tunnels which are formed along the route and which extend from the access point to allow access for piling and support-base portions to be installed and for the guide means thereon to be exposed when required to allow the deck structures to be jacked along the same.

5. The method according to claim 4 wherein the at least first and second support bases includes a series of piles depending downwardly therefrom, one or more base units supported by the piles and on the upper and/or side walls of the base units guide means are formed.

6. The method according to claim 1 wherein at least one of the said first and second support bases forms at least part of the side walls of the tunnel structure when formed.

7. The method according to claim 1 wherein the deck structures are formed prior to advancement along the guide means, either being cast at or prior to delivery at the access point.

8. The method according to claim 1 wherein the deck structures are moved along the guide means by jacking means provided at the access point and/or at locations along the tunnel route from the access point to provide jacking force to move the deck structures into position.

9. The method according to claim 1 wherein the excavation is performed using one or a combination of tunnelling excavation in which a shield is provided at the leading deck structure and tunnelling excavation is performed, and/or open excavation in which the excavation work is performed along and downwardly from the surface.

10. The method according to claim 1 wherein the material to be removed is placed to a side of the route for subsequent use for reclamation or removal.

11. A tunnel formed using the method as described in claim 1.

12. A method according to claim 1 wherein tunnelling excavation is performed to form part of the excavation distance along the said route.

13. A tunnel and tunnel apparatus said tunnel formed from a support base including guide means formed thereon, side walls and a roof structure formed from one or more deck structures movable along and supported by the guide means of the support base, the support base includes at least first and second, spaced apart, portions, which include the guide means formed therein and the deck structures span the guide means formed in the respective support base portions and said tunnel includes at least one access point from which the deck structures are advanced along the guide means and from which at least part of the said tunnel apparatus extends and wherein during formation the top face of the deck structures which have been advanced into position form a support surface for positioning excavation apparatus thereon adjacent a location at which excavation is to be performed outside of the tunnel and/or for vehicles to move along the top face for movement of excavated material and once the tunnel is formed material is moved over the top face of the deck structures to allow reinstatement work to be performed.

14. The tunnel according to claim 13 wherein the tunnel includes, a first series of deck structures which define a first portion of the tunnel leading from the access point and a second series of deck structures, spaced from the first, which define a second portion of the tunnel leading from the access point.

15. The tunnel apparatus according to claim 13 wherein passageways are spaced apart along a substantially horizontal or vertical plane.

* * * * *